US010773256B2

(12) United States Patent
Wu et al.

(10) Patent No.: US 10,773,256 B2
(45) Date of Patent: Sep. 15, 2020

(54) APPARATUS FOR DETECTING ANALYTE IN SAMPLE

(71) Applicant: Hangzhou Biotest Biotech Co., LTD., Hangzhou (CN)

(72) Inventors: Zhiqiang Wu, Zhejiang (CN); Yangyu Zhu, Zhejiang (CN); Liang Hong, Zhejiang (CN)

(73) Assignee: Hangzhou Biotest Biotech Co., LTD., Hangzhou (CN)

( * ) Notice: Subject to any disclaimer, the term of this patent is extended or adjusted under 35 U.S.C. 154(b) by 183 days.

(21) Appl. No.: 15/644,148

(22) Filed: Jul. 7, 2017

(65) Prior Publication Data

US 2018/0029031 A1 Feb. 1, 2018

(30) Foreign Application Priority Data

Jul. 27, 2016 (CN) ..... 2016 1 06079834
Jul. 27, 2016 (CN) ..... 2016 1 06132817

(51) Int. Cl.
*B01L 3/00* (2006.01)

(52) U.S. Cl.
CPC ..... *B01L 3/5023* (2013.01); *B01L 2200/06* (2013.01); *B01L 2200/14* (2013.01); *B01L 2300/0825* (2013.01); *B01L 2300/0848* (2013.01); *B01L 2400/086* (2013.01)

(58) Field of Classification Search
CPC ..... B01L 3/5023; B01L 2200/06; B01L 2200/14; B01L 2300/0825; B01L 2300/0848; B01L 2400/086; B01L 3/50
See application file for complete search history.

(56) References Cited

U.S. PATENT DOCUMENTS 5,160,486 A * 11/1992 Schlipfenbacher ..... G01N 33/54386 422/412
5,556,789 A * 9/1996 Goerlach-Graw .... B01L 3/5023 422/562
7,244,392 B1 * 7/2007 Konecke ..... A61B 10/007 422/408
8,470,609 B2 * 6/2013 Chen ..... B01L 3/5023 422/420
2002/0085953 A1 * 7/2002 Parker ..... A61B 10/007 422/412

* cited by examiner

*Primary Examiner* — Samuel P Siefke
*Assistant Examiner* — Quocan B Vo
(74) *Attorney, Agent, or Firm* — Jiangqiong Liu

(57) ABSTRACT

The present invention provides an apparatus for detecting an analyte in liquid sample, including a channel for arranging the test strip, with one opened end and the other end is closed, wherein the channel includes an anti-flooding structure where the cross sectional area of the channel is reduced. The apparatus provided in the present invention can prevent the flooding phenomenon of the test strip, and reduce the error rate.

13 Claims, 8 Drawing Sheets

Drawings

Drawings

Drawings

Drawings

Drawings

Drawings

APPARATUS FOR DETECTING ANALYTE IN SAMPLE

The application claims China to have the priority of the application of the following innovation-creation: Chinese patent application number: 2016106132817, application date: Jul. 27, 2016, title: an apparatus for detecting the analyte in sample; and Chinese patent application number: 2016106079834, application date: Jul. 27, 2016, title: a detection card for preventing flooding of the test strip. All descriptions, drawings, abstracts and claims of the earlier application are a part of the application.

FIELD OF THE INVENTION

The present invention relates to a detection card containing the test strip, in particular, to an apparatus containing the test strip in the field of rapid diagnosis.

BACKGROUND

At present, the detection apparatus for detecting the presence or absence of analyte in sample is widely used in hospitals or homes, and such apparatus for rapid diagnosis includes one or more test strips, such as early pregnancy detection, drug abuse detection. The apparatus is very convenient, and the detection result can be obtained on the test strip after one minute or no more than ten minutes.

In such detection apparatus, the test strip is generally located on a certain detection card. The detection card can be a strip shape mould or a plug board, and generally, it is formed by card slots or channels, and a card slot or channel can contain one test strip. In this way, the detection card with test strips can be used alone or together with the container. When such detection card is used to contain the test strip, the test strip can be used directly to detect the presence or absence of the interested substance in the sample, which can be liquid sample such as urine. When inserting the detection card with test strips into the sample, or allowing the liquid sample to flow into the container with a detection card, the liquid flows into the detection card disorderly, and often floods into the card slot, the channel or the chamber containing the test strip within a short time, thus, a phenomenon generally called "flooding" is caused, and the normal work and reaction of the test strip is influenced.

Therefore, it is necessary to improve the traditional detection card carrying test strips, to avoid flooding and improve the accuracy and effectiveness of the test strip.

SUMMARY

To solve the problems in the prior art, the present invention provides a detection card, including a channel for containing test strip, with one end closed and the other end having an opening through which the fluid sample detected can enter the channel, wherein the channel includes an anti-flooding structure. Or, the present invention provides a channel, with one end closed and the other end having an opening through which the fluid sample detected can enter the channel, wherein the channel includes an anti-flooding structure. Preferably, the liquid entering the channel contacts with the test strip, and more preferably, contacts with the sample receiving area of the test strip, or only contacts with such area.

In some preferred ways, the anti-flooding structure is located near to the channel's opening.

In some preferred ways, the anti-flooding structure is located in the upstream of the labeled area on the test strip or far away from the labeled area. In some preferred ways, the anti-flooding structure is located near to the fluid applying area of the test strip or not in the same horizontal position of the labeled area. Preferably, the anti-flooding structure is located near to the water line of the test strip, and more preferably, the anti-flooding structure is located in the downstream of the water line and the upstream of the labeled area.

In some preferred ways, the anti-flooding structure includes a convex element in the channel, which allows the cross sectional area of part of the channel to be decreased. In some preferred ways, the convex elements are respectively located on the walls at both sides of the chamber, protruding towards the channel. Preferably, the anti-flooding structure decreases the cross sectional area of, or narrows part of the channel.

In some preferred ways, the cross sectional area of the channel's opening is greater than that of the position in the channel having anti-flooding structure. In some preferred ways, the opening is wider than the channel interior.

In some preferred ways, the channel is divided into two parts by the anti-flooding structure, one is the first section of the channel from the structure to the opening of the channel, and the other is the second section of the channel from the structure to the closed end of the channel; wherein the cross sectional area of the first section is greater than that of the second section, or the cross sectional area of part of the first section is greater than that of the second section, or the cross sectional area of each part of the first section is greater than that of the second section. The anti-flooding structure provided in the present invention is formed at the junction between the first section and the second section, or the junction narrows the channel. Preferably, the junction is an area that is narrowed gradually, and where the channel becomes narrower, forming the anti-flooding structure provided in the present invention. When the channel is cylindrical, its cross sectional area can be used to measure its size; and when it is rectangle or cuboid, the wider the channel, the bigger the total cross sectional area under the condition of the same height, therefore, the first section can be wider than, and as high as the second section.

Preferably, the channel's opening is wider than, and also higher than the narrow position.

In some preferred ways, the channel includes a base plate and a card slot structure, the two form the channel with one end opened and the other closed, and the opening is located near to the sample-applying area of the test strip. Preferably, the card slot includes a narrow structure that divides the card slot into two parts, and the narrow structure is narrower than other positions of the card slot. Preferably, a long and thin slot is provided on the top of the card slot, running through the whole channel or the top of the whole card slot.

In some preferred ways, the chamber channel further includes a test strip, the sample-applying area of the test strip is located near to the channel opening, and the sample absorbing area is located on or near to the closed end of the channel. In some preferred ways, the labeled area on the test strip is located near to, and preferably in the downstream of the anti-flooding structure in the channel.

In all specific embodiments mentioned above, the channel on the detection card for containing test strip includes a transparent flat plate structure and a card slot structure, wherein the two form the channel. Preferably, the card slot structure is nontransparent. In some preferred ways, the detecting area of the test strip can be seen through the flat plate structure, or the detecting area is arranged directly opposite or facing the flat plate structure.

In another aspect, the present invention provides a detection apparatus, wherein the apparatus includes the above mentioned detection card or channel, the detection card includes a channel for containing test strip, with one end closed and the other end having an opening, through which the fluid sample detected can enter the channel, and the channel includes an anti-flooding structure. In some preferred ways, the apparatus further includes a test strip, wherein the test strip is located in the said channel. All ways of the anti-flooding structure mentioned above can be included in the detection apparatus in the present invention. Preferably, the anti-flooding structure is located under the labeled area on the test strip, or between the labeled area and the sample area; or the labeled area is located in the downstream of the anti-flooding structure.

In one preferred way, the apparatus further includes a chamber for containing liquid sample, wherein the detection card is located in the chamber, and the sample-applying area of the test strip is close to the bottom of the chamber, in this way, the liquid sample in the chamber can enter the channel through the opening to contact the sample-applying area of the test strip, and then, the liquid passes through the labeling area, detecting area, control area (if any) and finally, the water absorbing area (if any) successively from the sample-applying area along with the test strip.

The present invention provides a method for detecting the analyte in the fluid sample, the method includes: providing a detection apparatus, the detection apparatus includes a detection card, and the detection card includes a channel for containing the test strip, with one end closed and the other end having an opening, through which the fluid sample detected can enter the channel, wherein the channel includes an anti-flooding structure, and the channel includes a test strip, the anti-flooding structure is located between the labeled area of the test strip and the channel's opening; let the fluid sample enter the channel through the opening, and let the sample-applying area of the test strip contact with the fluid sample in the channel, so as to detect the analyte in the fluid sample. Or the anti-flooding structure is located under the labeled area of the test strip and above the channel's opening.

In some preferred ways, the anti-flooding structure is located near to the channel's opening.

In some preferred ways, the anti-flooding structure is located under, or far away from the labeled area of the test strip. In some preferred ways, the anti-flooding structure is located near to the fluid applying area of the test strip or not in the same horizontal position of the labeled area.

In some preferred ways, the anti-flooding structure includes a convex element in the channel, which allows the cross sectional area of the channel to be decreased. In some preferred ways, the convex elements are respectively located on the walls at both sides of the chamber, protruding towards the channel.

In some preferred ways, the cross sectional area of the channel's opening is greater than that of the position in the channel having anti-flooding structure. In some preferred ways, the opening is wider than the channel interior.

In some preferred ways, the channel is divided into two parts by the anti-flooding structure, one is the first section of the channel from the structure to the opening of the channel, and the other is the second section of the channel from the structure to the closed end of the channel; wherein the cross sectional area of the first section is greater than that of the second section. When the channel is cylindrical, its cross sectional area can be used to measure its size; and when it is rectangle or cuboid, the wider the channel, the bigger the total cross sectional area under the condition of the same height, therefore, the first section can be wider than, and as high as the second section.

In some preferred ways, the chamber channel further includes a test strip, the sample-applying area of the test strip is located near to the channel opening, and the sample absorbing area is located on or near to the closed end of the channel. In some preferred ways, the labeled area on the test strip is located near to the anti-flooding structure in the channel.

BRIEF DESCRIPTION OF THE DRAWINGS

FIG. 1 is a schematic diagram of the present invention and a structural comparison diagram with the traditional channel, wherein

DETAILED DESCRIPTION

Figures 1A, 1B, 1C, 1D, 1E:
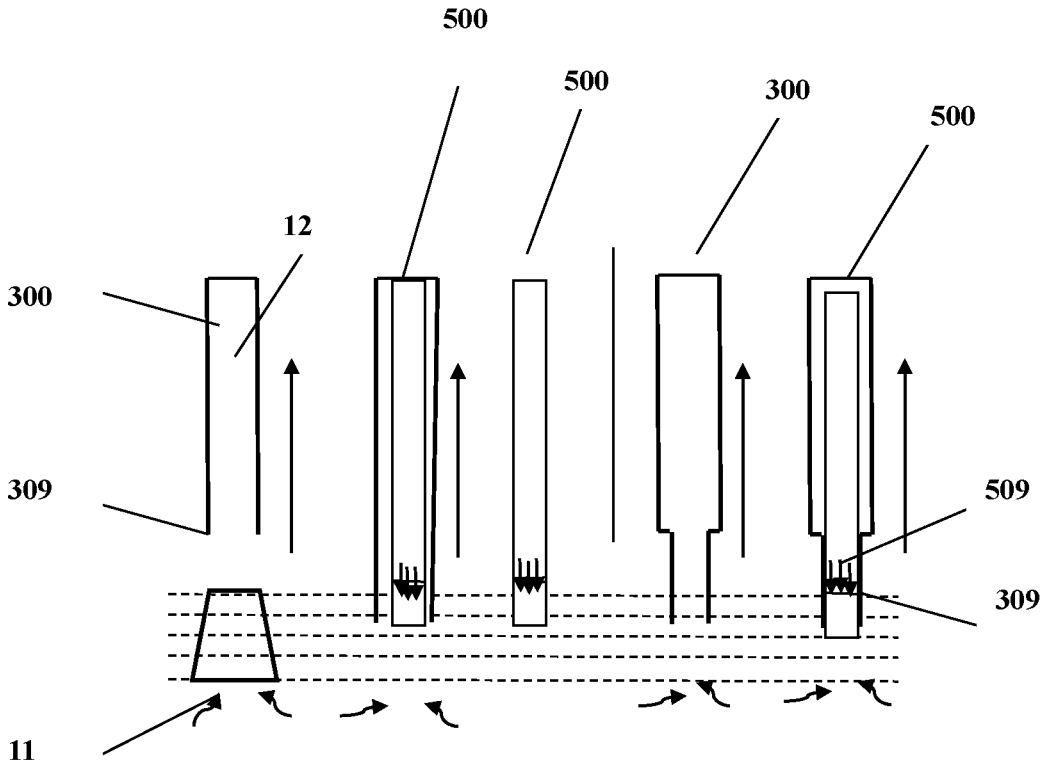
Fig.1A Fig.1B(Prior art) Fig.1C(Prior art) Fig.1D Fig.1E
FIG. 1A and FIG. 1D are schematic diagrams of the detection card in the present invention.
FIG. 1B is a schematic diagram of the traditional detection card carrying test strip.
FIG. 1C is a schematic diagram of the test strip.
FIG. 1E is a combined schematic diagram of the detection card and the test strip in one embodiment of the present invention.

The structure and technical terms used in the present invention is further described in the following.

Detection

Detection means to assay or test the presence or absence of a substance or material, including but not limited to chemical substances, organic compounds, inorganic compounds, metabolic products, medicines or drug metabolites, organic tissues or metabolites of organic tissues, nucleic acids, proteins or polymers. Additionally, detection means to test the quantity of a substance or a material. Furthermore, assay also means immune detection, chemical detection, enzyme detection, etc.

Downstream and Upstream

Downstream and upstream are divided according to the flow direction of liquid, and generally, liquid flows from upstream to downstream regions. The downstream region receives liquid from the upstream region, and also, liquid can flow to the downstream region along the upstream region. Here we often divide the regions according to the flow direction of liquid. For example, on some materials that use capillary force to promote liquid to flow, liquid can flow against the gravity direction, at this time, the upstream and downstream regions are still divided according to the flow direction of liquid. For example, on the test strip, the liquid flows from the upstream sample-applying region to the downstream labeled region, and then the liquid in the labeled region flows to the downstream detection region.

Sample

Samples referred in the present invention are those substances that can be used to detect, assay or diagnose the presence or absence of interested analyte. For example, samples can be fluid samples such as liquid samples, including blood, blood plasma, serum, urine, saliva and various secretion, or liquid solutions formed by solid and semisolid samples after being pretreated. The samples collected can be used in immune detection, chemical detection, enzyme detection or other detection methods to detect the presence or absence of analyte.

Test Strip

The test strips used in the present invention can be those what we commonly called lateral flow test strip 500, whose specific structure and detection principle are well known by general technicians in the prior art. Common test strip 500 includes a sample-applying area 503, a labeled area 502, a detecting area 504 and a water absorbing area 501, wherein the sample collecting area includes a sample receiving pad, the labeled area 502 includes a labeled pad, the water absorbing area 501 can include a water absorbing pad, and the detecting area 504 includes necessary chemical substances for detecting the presence or absence of analyte, such as immunoreagents or enzyme chemical reagents. The nitrocellulose membrane test strip is commonly used, that is, the detecting area 504 includes a nitrocellulose membrane on which specific combination molecule is fixed to display the detecting result; and other test strips such as cellulose acetate membrane or nylon membrane test strips can also be used. Of course, in the downstream of the detecting area there can also be a detecting result control area 505. Generally, test strips appear on the control area and the detecting area in the form of a horizontal line, that is a detection line or a control line, and such test strips are traditional. Of course, they can also be other types of test strips using capillary action for detection. In addition, there are often dry chemical reagent components on the test strip, such as fixed antibody or other reagents. When the test strip meets liquid, the liquid flows along the test strip with the capillary action, and the dry reagent components are dissolved in the liquid, then the liquid flows to the next area, the dry reagents are treated and reacted for necessary detection. The liquid flow mainly relies on the capillary action.

Analyte

Examples that can use the analyte related to this invention include some hapten substances, including drugs (such as drug abuse). "Drug abuse" (DOA) means to use drugs (often to paralyze the nerves) for non-medical purposes, which will lead to physical and mental damages, and people who use drugs will be dependent on, addicted to drugs and/or die. Examples of drug abuse include abuse of cocaine, amphetamine AMP (e.g. Black Beauty, white amphetamine tablets, dextroamphetamine, dextroamphetamine tablets, Beans); methylamphetamine MET (crank, meth, crystal, speed); barbiturate BAR (such as Valium, Roche Pharmaceuticals, Nutley, N.J.); sedatives (i.e. sleeping adjuvant); lysergic acid diethylamide (LSD); inhibitors (downers, goofballs, barbs, blue devils, yellow jackets, methaqualone); tricyclic antidepressants (TCA, i.e. imipramine, amitriptyline and doxepin); methylene dioxymetham-phetamine MDMA; phencyclidine (PCP); tetrahydrocannabinol (THC, pot, dope, hash, weed and etc.); opiates (i.e. morphine MOP or opium, cocaine COC, heroin, OXY); antianxiety drugs and sedative hypnotics, the antianxiety drugs are drugs mainly used to relieve anxiety, tension, fear and stabilize emotions, having the function of hypnosis and sedation, including BZO (benzodiazepines), atypical BZ, fused dinitrogen NB23C, benzodiazepines, ligand of BZ receptors, open-loop BZ, diphenylmethane derivatives, piperazine carboxylate, piperidine carboxylate, quinazolinones, thiazines and thiazole derivatives, other heterocyclic, imidazole sedatives/painkillers (such as OXY, MTD), propanediol derivatives-carbamates, aliphatic compounds, anthracene derivatives and etc. The detection apparatus provided in this invention can also be used to detect medicines that are easy to overdose for the medical purpose, such as tricyclic antidepressants (imipramine or analogues) and acetaminophen. These medicines will be resolved into different micromolecular substances after being absorbed by human body, and these micromolecular substances will exist in blood, urine, saliva, sweat and other body fluids or in some of the body fluids.

Detection Apparatus

Figure 5:
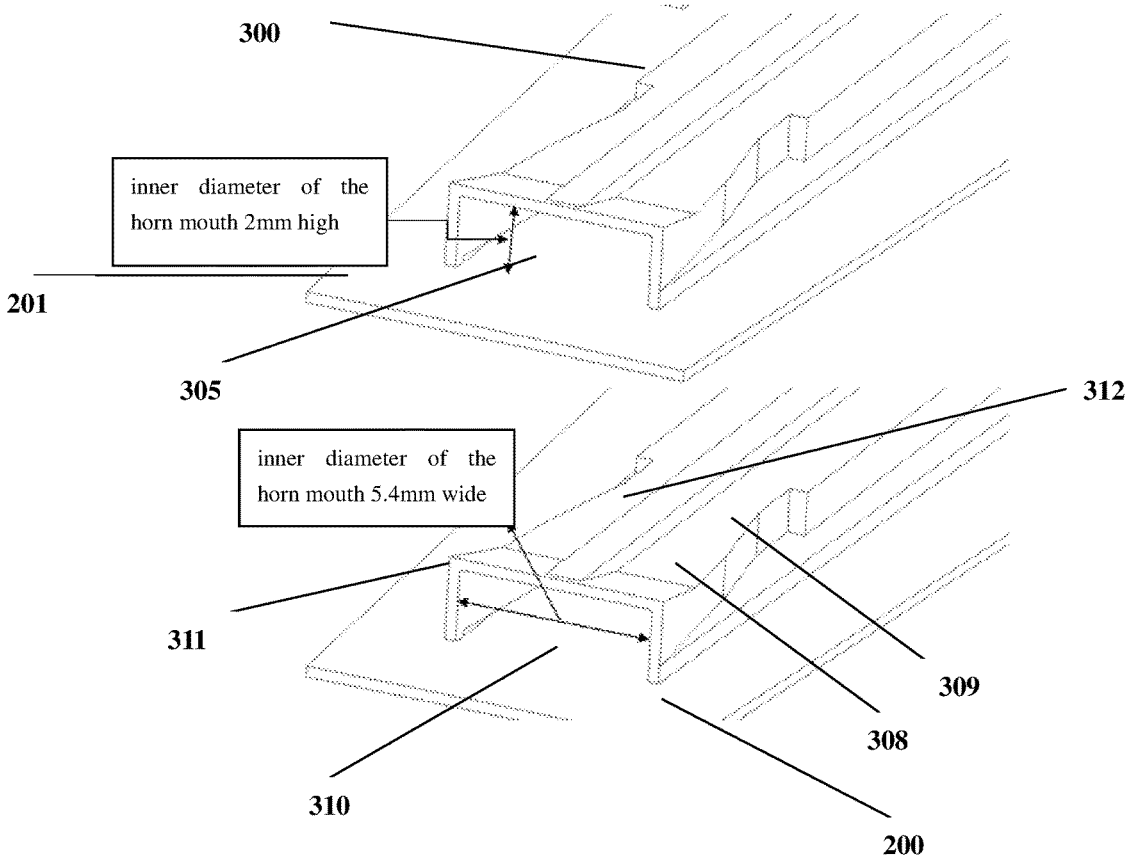
FIG. 5 is a partially enlarged schematic diagram of one channel.
Figure 7:
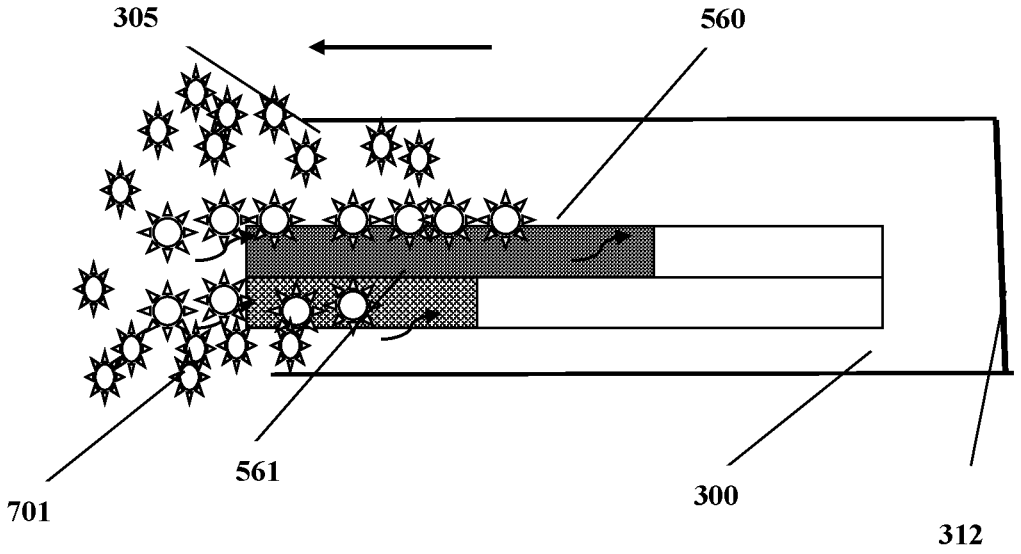
Fig.7 (Prior art)
FIG. 7 is a schematic diagram of the flooding phenomenon caused by the liquid flow in the traditional channel containing test strip.
Figure 8:
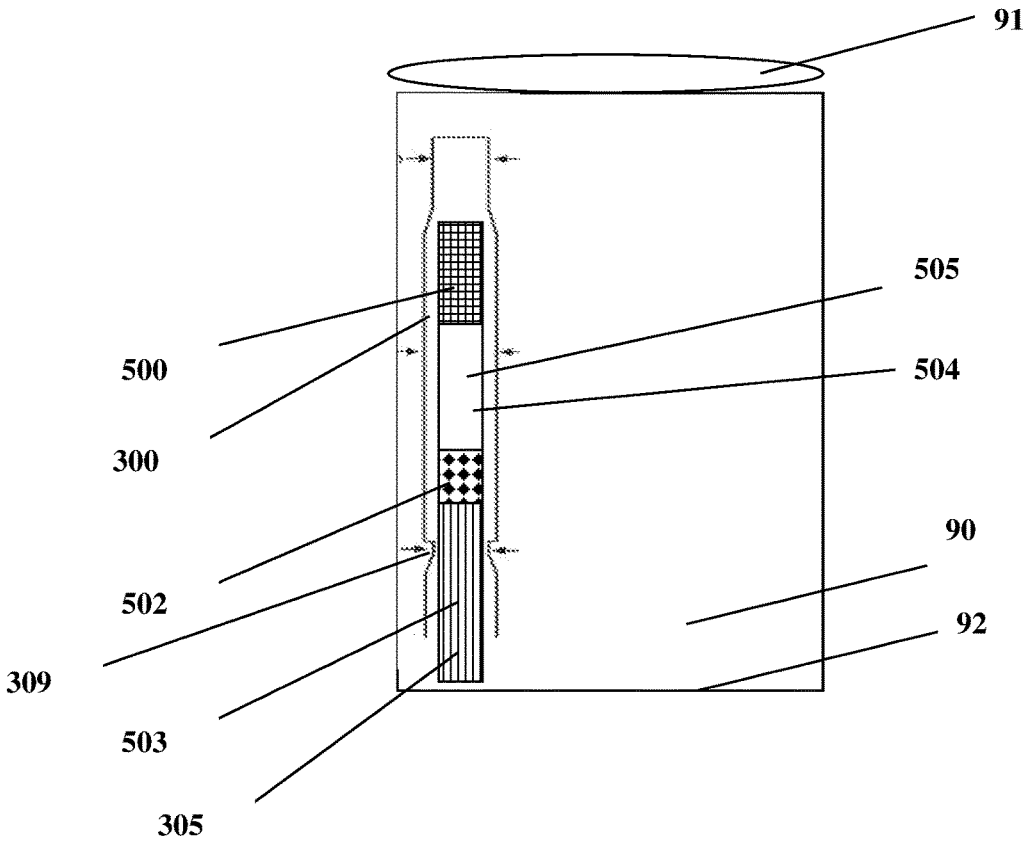
FIG. 8 is an assembled schematic diagram of the urine cup containing the channel provided in the present invention in one specific embodiment of the present invention.

The detection apparatus refers to the apparatus for detecting the presence or absence of the analyte in the sample. In the present invention, it, in particular, refers to the detection apparatus used in the field of rapid diagnosis, such as test strip 500, detection card or insertion piece, detection stick, detection cup (as shown in FIG. 8) or other types of detection apparatus. Here, the test strip is inserted into the channel 300 of the detection card 100 (FIG. 2), and its sample-applying area is exposed outside from the opening 305 (as shown in FIG. 5 and FIG. 7), thus forming the detection card, and the detection can be completed independently by the detection card itself. Referring to FIG. 1A, we use one of the channels to explain the detection principle: the detection card is inserted into the liquid sample, and as the channel of the detection card has a closed end 12 and an opened end 11, a part of the liquid sample flows into the channel and forms closed gas inside the channel, and under the internal and external pressure, the liquid can only be kept at a certain height after entering the channel. As the liquid flows into the channel and is kept at a fixed height, the sample-applying area of the test strip is immersed in the liquid, and the liquid flows upward along the test strip due to the capillary action, and thus the detection is completed. The presence or absence of lines on the detecting area of the test strip shows the presence or absence of the analyte in the sample. FIG. 1B is the assembly diagram of one traditional channel and test strip conducting detection by this principle.

Figure 2:
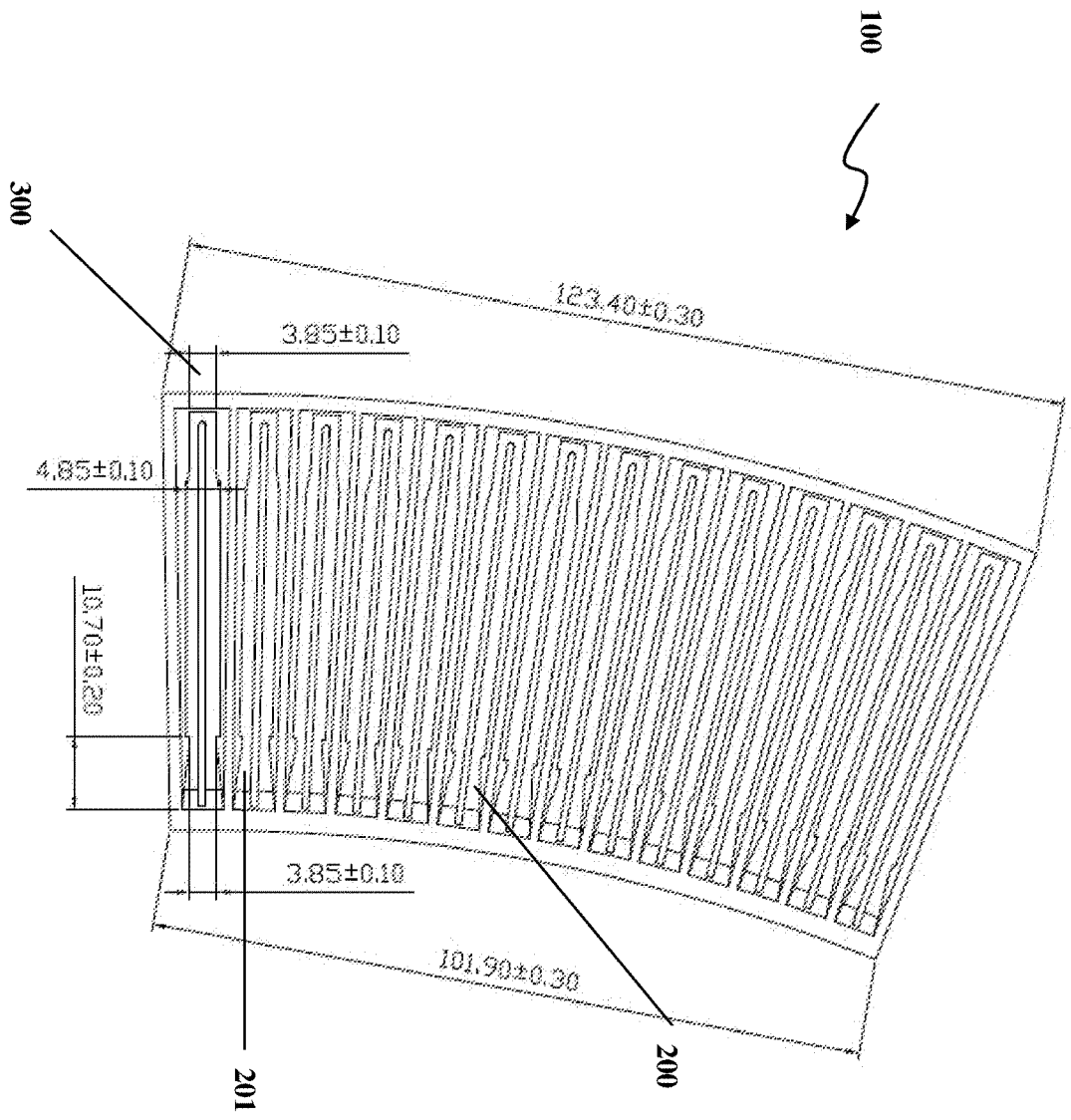
FIG. 2 is a schematic perspective view of the channel for containing test strip, and several channels are arranged on the detection card in one embodiment of the present invention.

Referring to FIG. 1B, a single test strip is used to detect the analyte in one or more liquid samples, or referring to FIG. 2, several test strips are arranged in several different channels 300 (the structure of each channel is basically the same), and each test strip corresponds to one analyte, in this way, by directly inserting the detection card 100 into the liquid sample, detection of several different analytes, such as 3, 10 or 15 different analytes, can be done at a time. Of course, referring to FIG. 8, the channel contains one test strip or referring to FIG. 2, several test strips are arranged in several channels, and the card is arranged in the container (such as what we commonly said the urine cup) shown in FIG. 8, allow the channel's opened end to be located at the bottom 92 of the urine cup, and the closed end 312 located near to the cup rim 91, in this way, when the urine cup collects urine, and as the urine enters the chamber 90 of the urine cup, just like the working principle of a single channel introduced before, when the internal and external air pressure are balanced, there is liquid of a certain height in each channel under the action of the closed gas, thus completing the reaction of each test strip.

The detection apparatus can include the detection card 100 and the matching components, as shown in FIG. 8, and the urine cup 2 can be regarded as a form of detection apparatus.

In the present detection, for such card or cup type detection apparatus, a detection card detection card 100 is needed to support the test strip 500, and only in this way, the apparatus can develop its detection function. The detection card detection card can include several channels 300, each channel 300 can include a test strip 500, and each test strip corresponds to one or more analytes. Or, at least one channel is needed, and a test strip is provided in the channel. However, in the existing traditional field, when the channel principle (closed gas and internal and external pressure) is used for the detection, as the test strip is located in the channel, and due to the cooperation between the test strip and the channel or their physical locations, the test strip often has many drawbacks. The test strip often contacts closely with the channel wall, and the capillary action is then produced, thus the line is broken. The way to solve the problem is to try not to allow the test strip to contact or contact in large area with the channel wall, as shown in FIG. 1B or FIG. 7, and try to let there be a certain distance between the channel and the test strip, such as 1-4 mm or further, or several millimeters. Although this method can relatively and effectively solve the problem of breaking lines, other problems may be caused, and the biggest one is "flooding". Whether the detection is conducted by directly inserting the test strip in a single channel into the liquid sample, or the detection apparatus (such as urine cup) including several channels is used to detect the analyte in the liquid sample, flooding phenomenon will occur.

Referring to FIG. 7, the flooding phenomenon means that plenty of liquid sample 701 flows to the test strip within a short period of time, thereby there is no time for the test strip 500 to absorb samples via capillary action and flow normally (561 is the flow trace of the liquid through normal capillary action), more samples flood onto the test strip or its surface (the liquid indicated by 560), and rapidly flow forward through the surface. As most liquid samples flow rapidly and directly on the surface rather than flowing under the capillary action, it is very difficult to rapidly and fully dissolve the dry chemical reagents on the test strip in the liquid sample within a short period of time, and thus lines will not appear on the detecting area or the detecting control area. Because the liquid on the surface flows faster without or less dependent on the capillary action, and wets other parts of the test strip in advance, so the test strip loses main capillary action in advance, and the liquid carrying with dry reagents on the test strip or in which the reagents are dissolved could hardly flow forward, by this way, although the test strip looks like being wetted, substantial reaction does not occur, so there will be no response on the detecting area or the control area, and the detection result will be inaccurate, and sometimes, there will be no detection result.

Referring to FIG. 7, in the traditional apparatus, the test strip 500 is generally not in direct contact with the channel 300 (at most the channel has a support frame), in this way, once the test strip and the channel are inserted into the liquid sample 701, as the operator is different, the insertion depth, speed and the state of the liquid sample 701 will be different (static or flow state, or splashing liquid). When the channel containing test strip enters the liquid sample, influenced by the short time microenvironment, plenty of liquid will flood into the channel within a very short period of time. Under the microenvironment, the liquid floods into the channel through the channel opening 305, and as the channel 300 has a closed end 312, gas is sealed by the liquid and the closed end 312, pressure is put on the liquid level, and more liquid entering the channel is restricted, and finally, the balance is achieved, and the liquid is at a certain height in the channel. Although it is quick to achieve the balance, in this process, the liquid is disorder and under the microstate, great impacts from different directions are produced on the test strip, thus causing the flooding phenomenon. Similarly, the channel containing test strip or the card is arranged in the urine cup in a static state, and when the liquid sample such as urine is poured into the urine cup, the liquid flows rapidly within a short period of time, and enters the channel, thus achieving the internal and external balance. Although the process is short, the liquid still flows fiercely under the microenvironment, and part of the liquid flows directly on the surface of the test strip, thus causing the flooding phenomenon, and leading to an invalid or inaccurate detecting result. Of course, different directions, angles and speeds of pouring liquid sample into the urine cup may also be the reason; further, when the detection is conducted, the subject directly pours the urine into the urine cup through the genitals, and the urine cup usually contains test strip with channel, under such condition, subjects do not have the professional operational ability, so the angle, size and quantity of urine they urinate in the urine cup will be different. If the test is conducted under a very complicated condition, in particular, the channel entrance is in a relatively complicated environment, flooding phenomenon will be caused more easily, and the final detecting result will be influenced.

To overcome such drawback, the present invention uses such detection card 100 or channel 300 not to allow the liquid sample to flow randomly in the channel, thus reducing the flooding. Further, the anti-flooding structure can rapidly let the liquid be quiet, or achieve internal and external balance, or reduce the phenomenon of liquid flow without the capillary action. As described before, the test strip mainly relies on the capillary action to let liquid flow, and the flooding is caused because the liquid flows on the test strip almost not or seldom under the capillary action.

Detection Card or Channel

Detection card 100 or channel 300 refers to the component or element for containing test strip 500. Referring to FIG. 1A and FIG. 7, the test strip 500 can be arranged in the channel 300 on the detection card, and the channel has a closed end 312 and an opened end 711, the outside liquid enters the channel through the opening. When the detection card 100 is placed vertically or horizontally, generally the test strip 500 will not fall out from the detection card 100, specifically, from the channel 300 on the detection card. Here, the detection card itself is the channel, or the channel itself is a form of detection card, and the channel contains the test strip. According to this, the present invention provides a channel, with one end closed 312 and the other opened 305, and in which the test strip is arranged. Preferably, the sample-applying area 503 of the test strip is located near to the channel opening 305, and the detecting control area is located near to the closed end 312. The component of the detection card 100 can be in the form of the card slot or the channel 300, or a card slot and a flat plate are assembled to form the channel 300 in the present invention. There can be one, two, three, four or more card slots or channels 300. Generally, one card slot or channel 300 can contain one test strip 500, and the test strip is often located at one end of the channel such as the closed end. The channel 300 or card slot includes a clamping structure for clamping the test strip. Of course, the clamping structure is not a required structure, and it is only a preferable technical solution.

In some preferred ways, the anti-flooding structure is located in the channel, and divides the channel into two different parts, such as the first channel from the channel opening to the anti-flooding structure and the second channel from the anti-flooding structure to the closed end, and the junction between the first channel and the second channel is the anti-flooding structure. The structure limiting the fluid reduces the cross sectional area of the channel or forms a partial and narrow space in the channel. In some specific ways, referring to FIG. 1A, the structure limiting the fluid is close to the opening end 11 and far from the closed end 12 of the channel 300. Preferably, the structure is located in the upstream of the labeled area of the test strip. In some preferred ways, the structure divides the channel into two different parts, and at the position close to the opening, referring to FIG. 1A, the structure narrows one position of the channel, at the same time, the wall of the channel extends outward along the narrow place gradually, thus the cross sectional area of the channel is also increased gradually, and thus the cross sectional area of the channel in the extended section is greater than that of the second channel. Or, referring to FIG. 1D and FIG. 1E, the structure divides the channel into two different parts, and at the position close to the opening, referring to FIG. 1D, the structure narrows one position of the channel, and the wall of the channel extends toward the opening 711 along the narrow place, the cross sectional area of the channel remains unchanged rather than being increased gradually, and thus the cross sectional area of the first channel is always lower than that of the second channel. FIG. 1B is the schematic diagram of the channel in the existing traditional detection apparatus. Practically, the whole channel has the same cross section, or the distance between walls is the same, and the wall is smooth or parallel. From the test in the present invention, we surprisingly find that the flooding phenomenon can be significantly reduced by 20-30% using the embodiments provided in the present invention (such as the solutions shown in FIG. 1A and FIG. 1D, or similar solutions), the defects of the existing products or the prior art can be improved greatly, and the detection performance can be improved (for example, referring to FIG. 1B, the channel containing test strip is used to detect the analyte in the sample).

In some preferred ways, several channels in the present invention (such as the single channel shown in FIG. 1A and FIG. 1D) can be integrated and arranged on the plastic plate, for example, referring to FIG. 2, such plastic plate includes several channels 300, such detection card 100 includes a base plate 200, and several card slot structures 30 are provided on the base plate, the card slot adheres to the base plate to form a complete channel 300. The base plate 200 can be a transparent plastic base plate, and the card slot structure can be of transparent or nontransparent material. Generally, the base plate is plane and transparent, and it is assembled with the card slot to form a complete channel. In some preferred ways, the channel 300 has a closed end 312 and an opened end with an opening 305, and there is an extension surface 201 of the transparent base plate at the channel opening 305, through which the sample applying pad on the sample-applying area 503 of the test strip can be seen clearly. Referring to FIG. 2, several channels are integrated on the transparent base plate, to form a fan-shaped card. As the card is flexible, it can be easily folded or enclosed to a certain shape and be inserted into the urine cup (description is detailed below), so as to form a complete detection apparatus. Alternatively, such insertion piece can also be used alone, and directly inserted into the liquid sample for detection.

Figure 3:
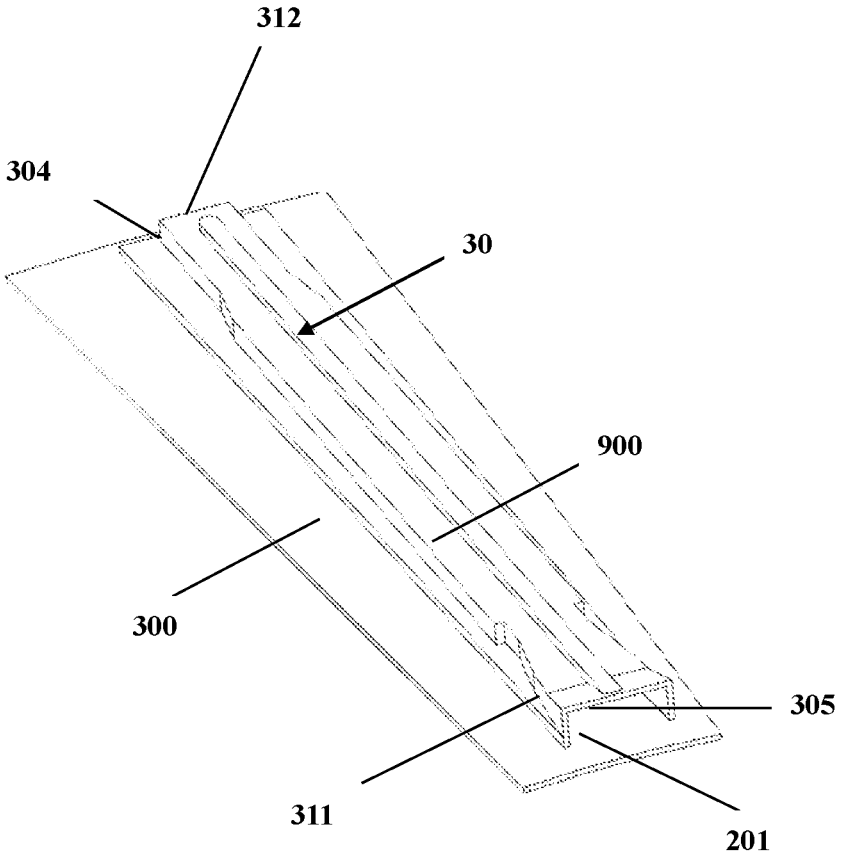
FIG. 3 is an enlarged schematic perspective view of one channel in FIG. 2.
Figure 4:
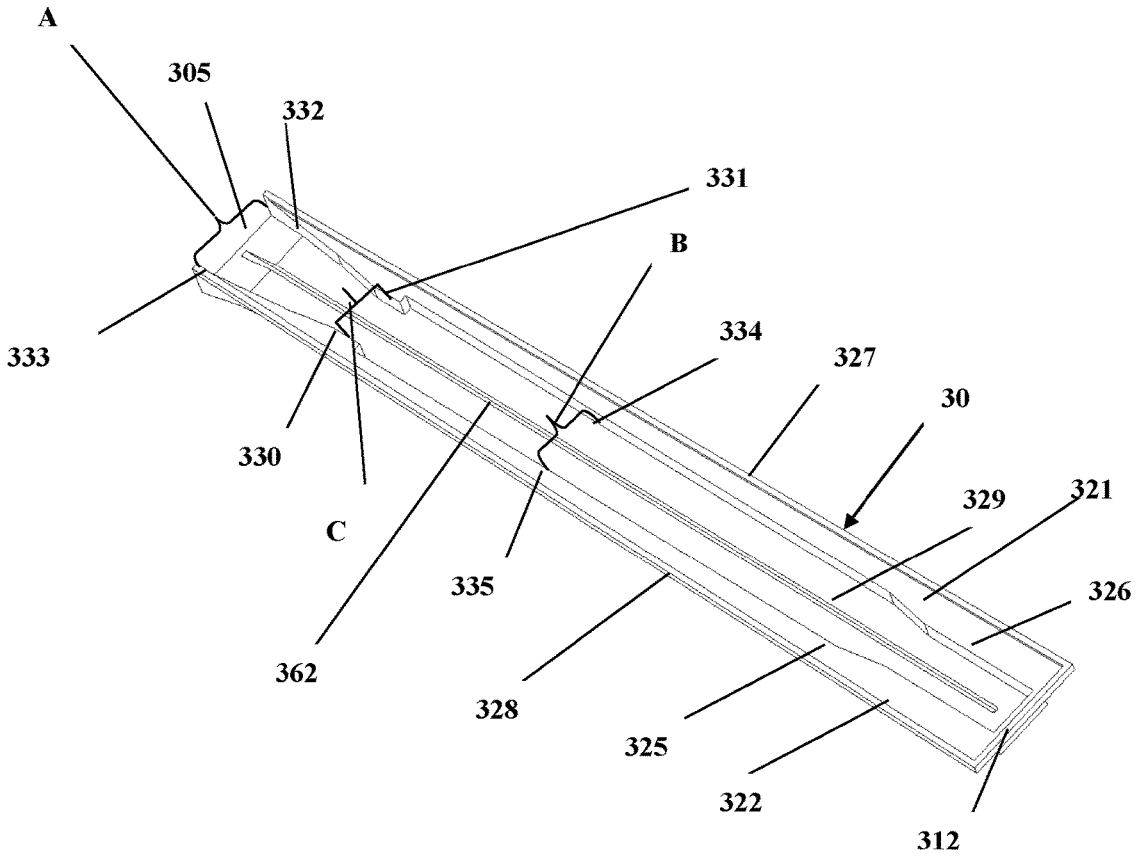
FIG. 4 is a perspective view of the card slot structure with the transparent flat plate structure removed.
Figures 6A, 6B:
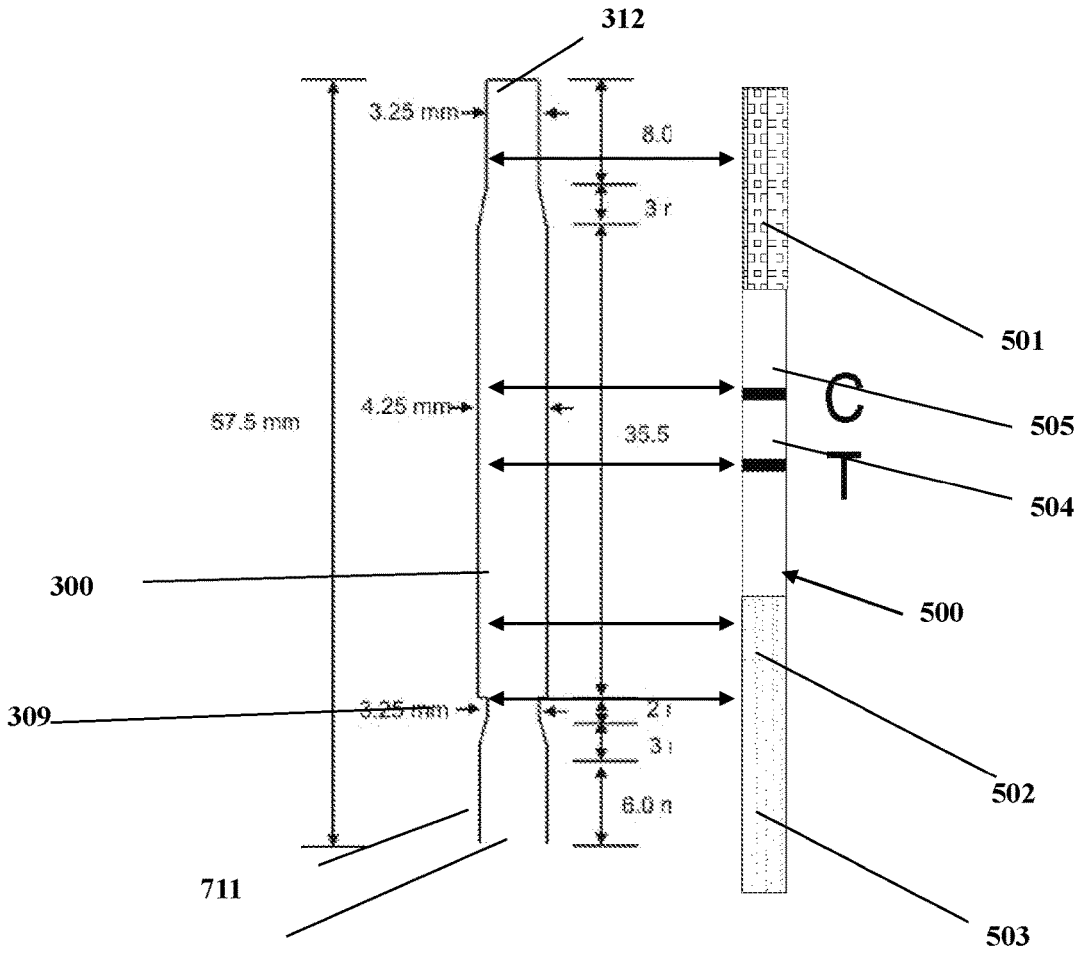
FIG. 6A is a longitudinal profile of one channel in another embodiment of the present invention.
FIG. 6B is an assembly position diagram of the test strip.

Below is the detailed description of such insertion piece in combination with specific figures. For example, FIG. 3-5 are the schematic diagrams of one channel in the insertion piece shown in FIG. 2. Referring to FIG. 3, the base plate 200 includes a card slot structure 30 (FIG. 4), the transparent base plate combines with the card slot to form a complete channel 300, with one end closed 312 and the other opened end 711 with an opening 305, and the outside liquid enters the channel through the opening. Such channel can be a cuboid-shaped channel, but the shape is not a regular cuboid. The two ends are narrower and the middle is wider, the opening end is wider than other positions of the channel, and the height is the same. Practically, different structural units with different cross sectional areas are formed because the height is the same and the width is different. FIG. 4 is the perspective view of the card slot structure of the channel (without the base plate 200). On the two sides of the approximate cuboid channel, there are two symmetrical wing plates 325 and 326, which have smooth surfaces 321 and 322, and on the smooth surface there are external edges 328 and 327, which have a smooth and flat plane of a certain width such as 1 mm or 2 mm. The plane adheres to the base plate 200 to form air-tight seal, thus sealing up the card slot by the base plate, and forming a complete channel 300. Referring to FIG. 4, the card slot structure 30 includes a card slot chamber 329 for arranging test strip. The chamber 329 has a certain depth, which can be expressed as the height of the channel (in this specific embodiment), and the card slot has different width, the width between two walls 332 and 333 of the card slot with different depth close to the opening 305 (the first width A) is greater than that between wall 334 and wall 335 (the second width B), but the width between wall 331 and wall 330 forming the depth of the card slot (the third width C) is lower than the second width. In this way, the junction between different width forms the anti-flooding structure in the present invention. Alternatively, referring to FIG. 4, the wall of the card slot extends outward (opening 305) gradually at the third width C, and the width between two walls is also increased gradually, forming a small "horn" mouth shape. Here, the "horn" mouth is not a necessary for the present invention, but a preferable solution. Referring to FIGS. 6A-B, such channel does not have a "horn" mouth, but on the channel, there is one narrow place 309 where the channel sinks inward, decreasing the inner diameter of the channel at this place, and actually, other places of the channel do not change, and the anti-flooding structure in the present invention is also formed at the narrow place 309. Such inward sunken structure can be a sudden or a gradual sinking and extend outward gradually. In this embodiment (FIG. 4), the third width C is formed by the convex of the card slot wall. Of course, different width of the card slot is formed by extruding the wall inward or by other ways, such as setting a square, round or other types of convex on the wall. In addition to this, when the card slot is cylindrical or semicircular, according to the same principle, different convex can be set on the wall of the card slot, to form different width of channel.

In some preferred ways, a tiny groove 362 is formed on the bottom of the card slot (FIG. 4), which runs through the whole bottom of the card slot (the top of the channel shown in FIG. 3). In this way, when the liquid floods into the channel opening, the groove 362 can exhaust air in time, thus achieving balance between the internal and external air pressure more rapidly in the closed channel, and improving the time for achieving the balance, letting the liquid return back to calm state more rapidly, and reducing the influence of flooding.

Further, referring to FIG. 5 and FIGS. 6A-B, the length of the whole card slot or channel is 57.5 mm, and the length of the test strip is 60 mm, so let a part of the test strip not be in the card slot, but expose outside. The second width B of the card slot is 4.25 mm, and the third width C is 3.25 mm. When there is a horn mouth such as in FIG. 5 (but there can also be no horn mouth, as shown in FIG. 6A), the first width A is 5.4 mm (FIG. 5), and the depth of the card slot is the same or the depth at different positions is different. Referring to FIG. 5, we can obviously see that the width from the third width C to the first width A is increased gradually, gently or fiercely, which is included in the essence of the present invention. In a preferable way, the width at the opening is increased gradually, or the channel height is increased gradually, for example, referring to FIG. 5, the narrow place 309 is sunken, and the width is increased gradually to the position 308. The height of the card slot is also increased gradually with the extension of the wall, thus forming a lip structure 311, and forming a relatively wide area 310 at the opening 305 and then a narrow area in the channel, which may be more likely to reduce the flooding phenomenon and reduce the impact effect of the partial liquid on the test strip.

For another example, in another way, referring to FIG. 6A (without the horn mouth), the third width C is 3.25 cm, which is less than the second width B (4.25 cm), the width of a segment at the sunken place is always less than the second width of the card slot (4.25 cm), and gradually, reach the structure of the second width, without the horn mouth (as shown in FIG. 5). However, the width of the test strip is 3.20 or 3.1 mm. When the test strip is arranged in the card slot, part of the test strip is at the narrow place 309. Although the test strip does not contact with the wall of the card slot, relative to the channel, the narrow place divides the test strip into two parts: one near to the opening and one far from the narrow place (such as position B). When the channel containing test strip is inserted into the liquid sample in various ways (vertically or at an angle), or the detection apparatus (such as the urine cup) with channel is used to receive the liquid sample (urine), the flooding phenomenon can be reduced significantly no matter what angle, speed and quantity of the urine entering the urine cup.

In some preferred ways, the anti-flooding structure is located in the upstream of the labeled area on the test strip, and generally, there is a water line in the upstream of the labeled area, representing the position line of inserting or immersing the test strip farthest, or submerging the test strip by the sample (509 shown in FIG. 1E), so all the anti-flooding structures (such as shown in FIG. 6A, narrow place 309 and 330 shown in FIG. 4, or 900 shown in FIG. 1A) are located near to the water line, such as paralleling the water line or in the downstream of the water line, and under the labeled area.

Below is the detailed description of the embodiments in the present invention in combination with specific drawings. These specific embodiments are only limited examples in the spirit of not going against the present invention, and other specific embodiments produced by combining the prior art and the present invention by the general technicians in this field are not excluded.

In the present invention, a series of DOA products are selected and used to conduct different detections, mainly including AMP (amphetamine), BAR (barbital), BZO (benzodiazepine), COC (cocaine), MET (methamphetamine), MDMA (dimethyl dioxymethylaniline), MOP (morphine), OPI (opium), OXY (oxycodone), MTD (methadone), PCP (phencyclidine), PPX (propoxyphene), TCA (tricyclic antidepressant), THC (tetrahydrocannabinol), COT (nicotine), BUP (buprenorphine), ACE (acetaminophen), KET (ketamine), MQL (methaqualone), and EDDP (2-acetal-1, 5 dimethyl-3, 3-diphenyl pyrrolidine).

Example 1: Comparison Experiment of Flooding Phenomenon Under Different Card Slot Structures The first card slot: the example relates to a detection card 100. Referring to FIG. 2, the detection card 100 includes a base plate 200 and a test strip 500. The detection card 100 includes several card slot structures 30, which form the channel together with the base plate 200, and the card slot 30 is rectangular, on which different width is set. For example, referring to FIG. 5, the third width C (3.25 mm) of the card slot is less than the second width B (4.25 mm), while the second width B is less than the maximum width A of the first width (5.4 mm), wherein the first width A is located under the labeled area of the test strip and near to the opening 305, and the second width B of the card slot is greater than the width of the test strip, the first width A is equivalent to or practically, equals to the width of the test strip (3.2 mm), and the other end of the channel is closed end 312. The test strip 500 in the detection card is used to detect the presence or absence of drugs in the sample, such as marijuana, cocaine and other substances, at this time, the height or depth of the card slots are the same.

The second card slot (compared with the traditional card slot structure): the difference between the second channel and the first channel is that, the width of the card slots we use is the same (all the distance between corresponding walls is 4.25 mm), and the width of the test strip is still 3.20 mm, the position where the test strip is located in the card slot is the same as that in the first card slot.

The third card slot: compared with the first channel, the difference is that, the card slot is rectangular, on which different width is set. For example, referring to FIG. 6A and FIG. 5, the third width C (3.25 mm) of the card slot is less than the second width B (4.25 mm), while the second width B equals to the first width A (4.25 mm), that is, the card slot has a sunken position, and does not have a horn mouth. Other positions are the same as those of the first card slot, and also, the width of their test strips is the same.

Operation method: when the detection is conducted, directly insert the detection card 100 (containing the above three channels) into the mixed solution containing several kinds of micro-molecular drugs, and maintain for one minute in the liquid sample, to ensure enough samples can be used for the detection. At this moment, the liquid sample will arrive at the labeled area 502 along the sample-applying area 503 of the test strip 500, and mix fully and evenly with the labeled substances on the labeled area, and then, it will arrive at the detecting area 504, and form detection symbols at the detecting result area of the detecting area 504, such as a detection line, for determining the presence or absence of the analyte in liquid sample. The table below is a statistical table for the number of flooding.

| Item | Number of tested card slots | Number of test strips having flooding | Rate of flooding | Number of test strips having control line | Rate of test strips having control line |
|---|---|---|---|---|---|
| The first card slot | 200 | 0 | 0% | 200 | 100% |
| The second card slot | 200 | 30 | 15% | 173 | 86.5% |
| The third card slot | 200 | 2 | 1% | 200 | 100% |

We can see from the table above that, when the card slot or channel has an anti-flooding structure, among all tested card slots, flooding phenomenon does not occur on the first card slot, and the occurrence rate of the control line is 100%; and when the same card slot or channel has no such structure for limiting fluid, the occurrence rate of the flooding is 15%, and the control line only occurs on 86.5% of the test strips, showing that 13.5% of the test strips have no control line. Regardless of the detection line, the result is invalid. Compared with the test strips in the existing traditional channel, the probability of occurrence of flooding in the third channel is much smaller.

Example 2: Comparison Experiment of Flooding Phenomenon Under Different Card Slot Structures (in the Urine Cup)-Laboratory The first card slot: the example relates to a detection card. Referring to FIG. 2, the detection card 100 includes a base plate 200 and a test strip 500. The detection card 100 includes several card slot structures 30, which form the channel together with the base plate, and the card slot is rectangular, on which different width is set. For example, referring to FIG. 5, the third width C (3.25 mm) of the card slot is less than the second width B (4.25 mm), while the second width B is less than the first width A (5.4 mm, the maximum width of the horn mouth), wherein the third width C is located under the labeled area 502 of the test strip and near to the opening 305, and the second width B of the card slot is greater than the width of the test strip, the third width C is equivalent to or practically, equals to the width of the test strip (3.2 mm), and the other end of the channel is closed. The test strip 500 in the detection card is used to detect the presence or absence of drugs in the sample, such as marijuana, cocaine and other substances.

The second card slot: the difference between the second card slot and the first card slot is that, the width of the card slots we use is the same (all the distance between corresponding walls is 4.25 mm), and the width of the test strip is still 3.20 mm, the position where the test strip is located in the card slot is the same as that in the first card slot.

The third card slot: compared with the first card slot, the difference is that, the card slot is rectangular, on which different width is set. For example, referring to FIG. 4, the third width C (3.25 mm) of the card slot is less than the second width B (4.25 mm), while the second width B equals to the first width A (4.25 mm), that is, the card slot has a sunken position, and does not have a horn mouth. Other positions are the same as those of the first card slot, and also, the width of their test strips is the same.

Operation method: when the detection is conducted, first bend the cards of the three channels with different structure (the first card slot, the second card slot and the third card slot) (as shown in FIG. 2), and insert them into the urine cup, wherein the channel opening is located in the bottom of the urine cup (FIG. 8), then pour urine into the urine cup rapidly (the height of the cup body is 75 mm, the length of the whole channel is 57.5 cm, the length of the test strip is 60 mm, and the volume of the urine cup is 50 ml), and fill the whole urine cup with liquid sample nearly within 2 seconds. Once the urine cup is filled with urine, the liquid sample will enter the channel through the opening, and arrive at the labeled area 502 along the sample sample-applying area 503 of the test strip 500, and mix fully and evenly with the labeled substances on the labeled area, and then, it will arrive at the detecting area 504, and form detection symbols at the detecting result area of the detecting area 504, such as a detection line, for determining the presence or absence of the analyte in liquid sample. The table below is a statistical table for the number of flooding.

| Item | Number of tested card slots | Number of strips having flooding | Rate of flooding | Number of test strips having control line | Rate of test strip with control lines |
|---|---|---|---|---|---|
| The first card slot | 1000 | 0 | 0% | 1000 | 100% |
| The second card slot | 1000 | 170 | 17% | 830 | 83% |
| The third card slot | 1000 | 4 | 0.4% | 1000 | 100% |

We can see from the table above that, when the card slot has an anti-flooding structure, among all tested urine cups, flooding phenomenon does not occur on the first card slot, and the occurrence rate of the control line is 100%; and when the same card slot or channel has no such structure for limiting fluid, the occurrence rate of the flooding is 17%, and the control line only occurs on 83% of the test strips, showing that 17% of the test strips have no control line. Regardless of the detection line, the result is invalid. Compared with the test strips in the existing traditional channel, the probability of occurrence of flooding in the third channel is much smaller.

Example 3: Comparison Experiment of Flooding Phenomenon Under Different Card Slot Structures (in the Urine Cup)-Clinical The first card slot: the example relates to a detection card. Referring to FIG. 2, the detection card 100 includes a base plate 200 and a test strip 500. The detection card 100 includes several card slot structures 30, which form the channel together with the dbase plate, and the card slot is rectangular, on which different width is set. For example, referring to FIG. 5, the third width C (3.25 mm) of the card slot is less than the second width B (4.25 mm), while the second width B is less than the first width A (5.4 mm, the maximum width of the horn mouth), wherein the third width C is located under the labeled area 502 of the test strip and near to the opening 305, and the second width B of the card slot is greater than the width of the test strip, the third width C is equivalent to or practically, equals to the width of the test strip (3.2 mm), and the other end of the channel is closed. The test strip 500 in the detection card is used to detect the presence or absence of drugs in the sample, such as marijuana, cocaine and other substances.

The second card slot: the difference between the second card slot and the first card slot is that, the width of the card slots we use is the same (all the distance between corresponding walls is 4.25 mm), and the width of the test strip is still 3.20 mm, the position where the test strip is located in the card slot is the same as that in the first card slot.

The third card slot: compared with the first card slot, the difference is that, the card slot is rectangular, on which different width is set. For example, referring to FIG. 4 and FIG. 5, the third width C (3.25 mm) of the card slot is less than the second width B (4.25 mm), while the second width B equals to the first width A (4.25 mm), that is, the card slot has a sunken position, and does not have a horn mouth. Other positions are the same as those of the first card slot, and also, the width of their test strips is the same.

Operation method: before the detection is conducted, first bend the cards of the three channels with different structure (the first card slot, the second card slot and the third card slot) (as shown in FIG. 2), and insert them into the urine cup (FIG. 8), wherein the channel opening is located in the bottom of the urine cup, then conduct clinical experiments on different persons, that is, collect their urine without professional operations, and generally, let them urinate in the urine cup directly through their genitals, and then observe the probability of occurrence of flooding phenomenon, with the results shown in the table below:

| Item | Number of tested card slots | Number of test strips having flooding | Rate of flooding | Number of test strips having control line | Rate of test strip having control lines |
|---|---|---|---|---|---|
| The first card slot | 5000 | 0 | 0% | 5000 | 100% |
| The second card slot | 5000 | 1000 | 20% | 4000 | 80% |
| The third card slot | 5000 | 100 | 2% | 5000 | 100% |

We can see from the table above that, when the card slot has an anti-flooding structure, among all tested urine cups, flooding phenomenon does not occur on the first card slot, and the occurrence rate of the control line is 100%; and when the same card slot or channel has no such structure for limiting fluid, the occurrence rate of the flooding is 20%, and the control line only occurs on 80% of the test strips, showing that 20% of the test strips have no control line. Regardless of the detection line, the result is invalid. Compared with the test strips in the existing traditional channel, the probability of occurrence of flooding in the third channel is much smaller.

Example 4: Experiment of Flooding Phenomenon Under Extreme Conditions

The first card slot: the example relates to a detection card. Referring to FIG. 2, the detection card 100 includes a base plate 200 and a test strip 500. The detection card 100 includes several card slot structures 30, which form the channel together with the base plate, and the card slot is rectangular, on which different width is set. For example, referring to FIG. 5, the third width C (3.25 mm) of the card slot is less than the second width B (4.25 mm), while the second width B is less than the first width A (5.4 mm, the maximum width of the horn mouth), wherein the third width C is located in the upstream of the labeled area 502 of the test strip and near to the opening 305, and the second width B of the card slot is greater than the width of the test strip, the third width C is equivalent to or practically, equals to the width of the test strip (3.2 mm), and the other end of the channel is closed. The test strip 500 in the detection card is used to detect the presence or absence of drugs in the sample, such as marijuana, cocaine and other substances.

The second card slot: the difference between the second card slot and the first card slot is that, the width of the card slots we use is the same (all the distance between corresponding walls is 4.25 mm), and the width of the test strip is still 3.20 mm, the position where the test strip is located in the card slot is the same as that in the first card slot.

The third card slot: compared with the first card slot, the difference is that, the card slot is rectangular, on which different width is set. For example, referring to FigA, the third width C (3.25 mm) of the card slot is less than the second width B (4.25 mm), while the second width B equals to the first width A (4.25 mm), that is, the card slot has a sunken position, and does not have a horn mouth. Other positions are the same as those of the first card slot, and also, the width of their test strips is the same.

Pour a certain urine into the chamber 90 in the urine cup (FIG. 8) to the designated scale, put the urine cup in the shaking table to shake it violently for about five minutes (the frequency is 1200 hz per second), and take it out to see the result. The results are shown in the table below:

| Item | Number of tested card slots | Number of test strips having flooding | Rate of flooding | Number of test strips having control lines | Rate of test strip with control lines |
|---|---|---|---|---|---|
| The first card slot | 300 | 1 | 0.3% | 300 | 100% |
| The second card slot | 300 | 35 | 11.6% | 260 | 86.7% |
| The third card slot | 300 | 5 | 1.7% | 296 | 98.7% |

Under extreme conditions, flooding phenomenon only occurs on one first card slot or channel, but the control line still occurs; while for the traditional channel, as it does not have an anti-flooding structure, the control line only occurs on 86.7% of the test strips, and does not occur on some of them, showing that the detection is invalid due to the influence of the flooding, and the third one is superior to the traditional one.

What is claimed is:

1. An apparatus for detecting an analyte in liquid sample, comprising a channel for arranging a test strip therein, the channel having one opened end and one closed end, wherein the channel has a length that extends between the opened end and the closed end, wherein the channel comprises an anti-flooding structure where a cross sectional area of the channel is reduced, wherein the channel comprises a tiny groove on the top of the channel, for exhausting air in time when a liquid sample floods into the channel as to achieve balance between the internal and external air pressure; and wherein the tiny groove runs along the length of the channel; wherein the channel is divided into two parts by the anti-flooding structure, one part is a first section of the channel from the anti-flooding structure to the opened end of the channel, and the other part is a second section from the anti-flooding structure to the closed end of the channel, and a cross sectional area of the first section is greater than that of a cross sectional area of the second section, and wherein the width of the first section is increased gradually from the anti-flooding structure toward the opened end and the channel height is increased gradually from the anti-flooding structure toward the opened end.

2. The detection apparatus according to claim 1, wherein the channel comprises a base plate and a card slot structure, and the base plate and the card slot structure form the channel with the opened end and the closed end, and the opened end is located near to the sample-applying area of the test strip.

3. The detection apparatus according to claim 1, wherein the test strip comprises a labeled area and the anti-flooding structure is located upstream of the labeled area.

4. The detection apparatus according to claim 2, wherein the base plate is transparent, and the card slot structure is non-transparent.

5. The detection apparatus according to claim 1, wherein a channel is divided into two parts by the anti-flooding structure, one part is the first section of the channel from the anti-flooding structure to the opened end of the channel, and the other is a second section of the channel from the anti-flooding structure to the closed end of the channel; and wherein one position near to the opened end of the channel is narrowed by the anti-flooding structure, at the same time, the wall of the channel extends outward along a narrow place gradually, thus the cross sectional area of the channel is also increased gradually, and thus the increased cross sectional area of the channel in the first section is greater than that of the second section.

6. The detection apparatus according to claim 1, wherein the apparatus further comprises a chamber for containing a liquid sample, the channel is located in the chamber, and the opened end of the channel is located near to the chamber's bottom.

7. The detection apparatus according to claim 2, wherein the card slot comprises a cuboid-shaped card slot, the card slot is divided into two parts: the first part with the opened end, and the second part with the closed end, and the width of the joint between the first part and the second part is decreased, thus forming a first width.

8. The detection apparatus according to claim 7, wherein a second width is formed at the opened end, a third width is formed at the closed end, and the first width is less than the third width.

9. The detection apparatus according to claim 8, wherein the third width is less than the second width.

10. The detection apparatus according to claim 1, wherein the anti-flooding structure comprises a convex element in the channel, and the convex element allows the cross sectional area of the channel to be reduced.

11. The detection apparatus according to claim 1, wherein the cross sectional area of the opened end is greater than that of a cross sectional area of the channel having the anti-flooding structure.

12. The detection apparatus according to claim 1, wherein a junction between the first section of the channel and the second section is provided with the anti-flooding structure.

13. The detection apparatus according to claim 1, wherein the channel comprises a base plate and a card slot structure, and the two form the channel with the opened end and the closed end.

* * * * *